United States Patent [19]

Flesch

[11] 4,349,354

[45] Sep. 14, 1982

[54] FURNACE FOR GASIFYING GRANULAR FUELS

[75] Inventor: Wilhelm Flesch, Heidelberg, Fed. Rep. of Germany

[73] Assignee: Davy International Aktiengesellschaft, Frankfurt, Fed. Rep. of Germany

[21] Appl. No.: 169,374

[22] Filed: Jul. 16, 1980

Related U.S. Application Data

[63] Continuation of Ser. No. 3,382, Jan. 15, 1979, abandoned.

[30] Foreign Application Priority Data

Jan. 14, 1978 [DE] Fed. Rep. of Germany ..... 2801574

[51] Int. Cl.[3] ..... C10J 3/56

[52] U.S. Cl. ..... 48/77; 48/67; 110/234; 122/4 D; 165/134 R; 422/146

[58] Field of Search ..... 122/4 D; 48/62 R, 63, 48/64, 73, 76, 77, 67, 68, 69; 266/190, 197; 110/234; 165/56, 57, 103, 134, 169; 422/146

[56] References Cited

U.S. PATENT DOCUMENTS

| | | | |
|---|---|---|---|
| 3,174,463 | 3/1965 | Reagan | 165/134 |
| 4,013,427 | 3/1977 | Geinhardt et al. | 48/67 |

FOREIGN PATENT DOCUMENTS

| | | | |
|---|---|---|---|
| 1421655 | 6/1972 | Fed. Rep. of Germany . | |
| 36075 | 1/1930 | France | 48/62 R |

OTHER PUBLICATIONS

Anwer et al., Kohlevergasung im Fluidatbett (Winkler-Vergasung) unter Druck, Brennetoff-Waime-Kraft 2/1976, pp. 57/60.

*Primary Examiner*—Peter F. Kratz

*Attorney, Agent, or Firm*—Bernard, Rothwell & Brown

[57] ABSTRACT

A shaft furnace is provided for gasifying granular fuels in a fluidized bed. Such a furnace comprises a gasification zone containing the fluidized fuel bed and an overlying gas cooling zone having surfaces cooled by the tube surfaces of a radiation tube boiler. By providing such a gas cooling zone with a cross-sectional area substantially greater than that of the gasification zone, the gas effluent is cooled in such a manner that residues entrained in the effluent do not sinter onto the surfaces of the equipment in the subsequent path of the effluent.

5 Claims, 1 Drawing Figure

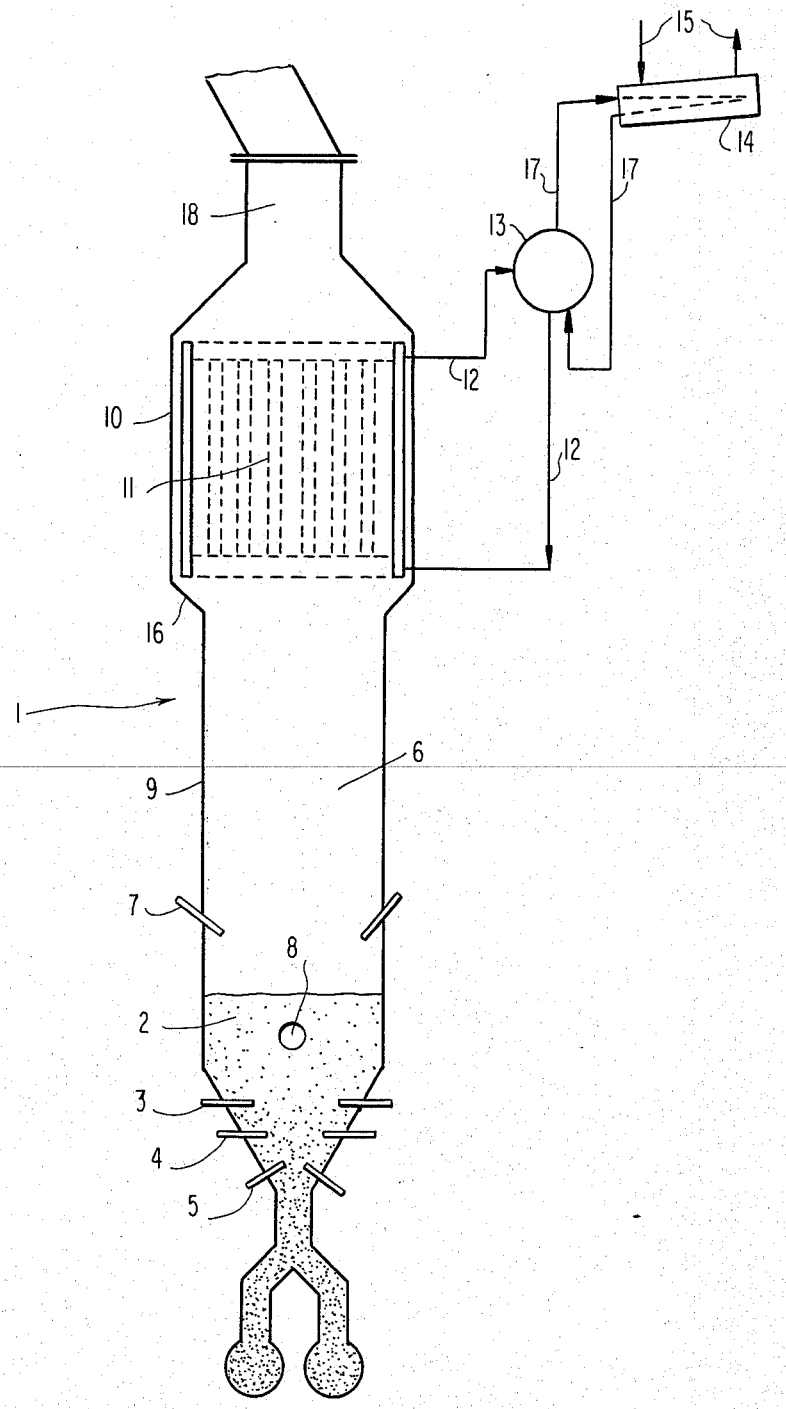
15
14
17
17
13
18
12
10
12
11
16
1
6
9
7
8
2
3
4
5

FURNACE FOR GASIFYING GRANULAR FUELS

This is a continuation, of application Ser. No. 003,382, filed Jan. 15, 1979 now abandoned.

The invention relates to a shaft furnace for gasifying fine-grained fuels, especially coal or coke, in a fluidised bed at normal to elevated pressure with indirect cooling of the gas duct situated above the after-gasification zone.

It is known to gasify granular and more especially finegrained fuels at normal or elevated pressure in a fluidised bed, endothermally reacting gasifying agents being introduced into the lowermost portion of the bed and exothermally reacting gasifying agents being introduced into the fuel bed at a distance above it. The fuel particles entrained upwardly with the gas produced in the fluidised bed are further gasified in the zone above the fluidised bed by gasifying agents introduced into this zone (after-gasification zone). The height of the fluidised bed is kept constant by fresh fuel continuously introduced into the fluidised bed.

With this operation care has to be taken that such a quantity of heat is extracted from the molten fly ash entrained with the produced gas before reaching the gas outlet that no sintering effects can occur at this point which would result in a premature breakdown of the gasifier. On the other hand, the heat extraction should not be greater than necessary to avoid sintering effects, since otherwise it has a disadvantageous effect on the maintenance of the gasification temperature in the after-gasification zone disposed therebeneath.

According to the German Auslegeschrift No. 1 421 655 water-cooled surfaces arranged in the upper section of the shaft furnace and designed as a radiation tube boiler with a closed water circuit and a small water content which tube boiler is a part of a waste-heat boiler, is used for this heat extraction. With this construction in addition to the advantage of a good utilisation of waste heat, no dangerous drop of the temperature can occur in the fluidised bed, even in the event of a tube burst, and the cooling effect can be controlled by the choice of the operating pressure of the radiation tube boiler as well as by the area of the cooling surfaces. A radiation of cold into the gasification zone is positively connected with the cooling effect on the gas flowing past. This cold radiation is not desired because the aim is to have a high temperature, particularly in the after-gasification zone to achieve a complete combustion of the fly ash. In order to keep the disadvantages of the radiation of cold into the gasification zone within economic limits, the height of the cooling surface must be limited to the diameter of the shaft in which it is arranged. This also restricts the cooling effect on the gas passing by and means that the gasification temperature may only be about 120° C. higher than the sintering point of the fly ash, which results in a fly ash combustion of a maximum of only 80%, even when reactive coals are gasified.

It is the object of the invention to improve the shaft furnace initially referred to in such a way that, firstly, an elevated gasification temperature of up to about 1300° C., which is necessary for the complete gasification of the fuel particles in the zone above the fluidised bed is achieved, but, secondly, the liquid ash particles entrained with the product gas at a high temperature are cooled to such a degree by the radiation of cold in the cooling surface zone without substantially impairing said elevated gasification temperature, that the particles can no longer sinter to parts of the equipment in the upper section of the gasifier shaft and in the subsequent gas duct. This means that the liquid ash particles have to be cooled more intensively than hitherto, namely by up to 300° C.

The invention accordingly refers to a shaft furnace for gasifying fine-grain fuels, especially coal or coke, in a fluidised bed at normal or elevated pressure, with indirect cooling of the gas duct above the after-gasification zone, comprising a radiation tube boiler installed in the gasifier shaft and having cooled internal surfaces in the form of radiation tube heating surfaces, which are designed as parts of a steam-generator, the radiation tube boiler having a small water content as compared with the heat content of the fuel bed and the radiation tube boiler surface installed in the gasifier shaft being dimensioned so that its cooling effect is only so great that the gasification residues entrained with the gas are no longer able to sinter to the equipment in the following gas duct.

With this shaft furnace the afore-mentioned object is achieved according to the invention in that the shaft section of the gasifier in which the cooling surfaces are arranged has a larger cross-section than that shaft section which is situated therebeneath and in which the gasification reaction takes place. Due to the enlargement of the shaft cross-section in the cooling zone, the residence time of the gases being drawn past is increased. Moreover, due to the distribution of the cooling surfaces over a larger cross-section, i.e. a reduction of the cooling surface density, the radiation of cold into the after-gasification zone is reduced, compared with a shaft furnace having the same cross-section in the gasifying zone and in the cooling zone and like cooling surface areas. The cooling surface is preferably set back into the recess formed by the enlargement of the shaft portion so that the reaction gas stream is annularly surrounded in the cooling zone by the radiation tubes. The radiation of cold into the after-gasification zone is likewise greatly reduced by this arrangement of the cooling surfaces, this making possible the use of more effective cooling surfaces for lowering higher fly ash temperature and hence the use of higher gasification temperatures.

Preferably, the cross-section of the shaft section which is provided with cooling surfaces is about twice as large as the shaft section situated therebetween for the gasification or after-gasification. As a result, the residence time of the passing gas is likewise doubled and the cooling effect is correspondingly increased. It is guaranteed by this embodiment that there is no fly ash sintering to the equipment downstream of the cooling zone, even with the usual fluctuations of the fuel composition and quality and thus of the sintering point of the fly ash.

The height of the cooling surface is preferably proportional to the diameter of the enlarged shaft section in which the cooling surface is arranged. The furnace according to the invention thus has a larger cooling surface compared with the known embodiment having the same shaft cross-section in both zones, which results in an increased cooling effect on the passing gas stream.

Furthermore, preferably the shaft section of the gasification zone directly passes over into the enlarged shaft section of the cooling zone so that an erosion effect accompanied with the enlargement of the shaft and due to gas eddies, is avoided on the cooling tube surfaces. In this way, the radiation of cold into the gasification zone is further reduced. It has proved to be advantageous that the two shaft sections are connected by a conical wall section, which is inclined by an angle of 45° to the furnace axis. With this arrangement, firstly there are no erosion effects due to gas eddies at the radiation tubes, and secondly an unnecessary radiation of cold into the gasification zone is avoided.

The radiation tube boiler is preferably designed as a free convection boiler with a closed water circuit. The heat of the generated steam is used via a condenser for the generation of steam, and preferably by connection to the water-tube boiler. The radiation tube boiler as a closed water circuit permits to operate with a small water volume content is this part of the steam-generating plant. Accordingly, in the event of a tube burst in the radiation tube boiler, the temperature of the shaft content is only slightly reduced by the water issuing into the shaft, so that there is no danger of an escape of oxygen from the furnace due to a too low temperature for the gasification reaction. The water which flows into the gasifier as a result of a tube burst should not extract from the fuel bed more than about 20% of the sensible heat of the bed by the vaporisation and heating of said water, so that the temperature does not fall below the reaction temperature for the conversion of the fuel with the oxygen.

An embodiment of the shaft furnace according to the invention is represented in the drawing in a diagrammatic form.

About 20 metric tons of incandescant coal having a grain size from 0 to 6 mm are disposed in a gasifier shaft 1 having an internal diameter of 4.40 meters. A fluidised bed 2 is maintained with this coal by use of gasifying agents, which are injected through the nozzles 3,4,5 into the gasifier 1.

The height of the fluidized bed 2 is maintained constant by fresh coal being continuously fed through the opening 8. The coal is partially gasified in the fluidised bed 2 at 980° C. The finer particles which are less reactive escape from the fluidised bed with the gas and are completely gasified with oxygen supplied through the nozzles 7 at a temperature of 1280° C. in the after-gasification zone 6 which is enclosed by the shaft section 9.

The cylindrical shaft is enlarged to a diameter of 6.0 meters in its upper section 10. The radiation tube heating surfaces 11 are arranged in this section representing the cooling zone close to the shaft wall. The lower section 9 and the upper section 10 of the shaft are connected by a conical wall section 16. The gas which together with fly ash is formed by the gasification of the coal has a temperature of about 1250° C. before entering the shaft section 10 and still a temperature of 980° C. at the reactor outlet 18 when leaving the said shaft section. The radiation tube boiler comprises the radiation tube heating surfaces 11, the water collecting drum 13 connected to the heating surfaces 11 by the pipes 12, and the condenser 14 which is connected to the drum 13 by pipes 17. The radiation tube boiler 11–14 is connected by pipes 15 to a waste-heat boiler (not shown), in which the gas passing off at 18 at a temperature of 980° C. is cooled down to 180° C.

What is claimed is:

1. A shaft furnace for gasifying fine-grained fuels such as coal or coke at normal or elevated pressure in a gasification zone comprising a fluidized bed and a diluted after-gasification zone above said bed with means for indirect cooling of the effluent gas in order to prevent gasification residues entrained with the gas from sintering to surfaces of the equipment in the subsequent path of the gas, said furnace comprising:

(a) a shaft section defining a fuel gasification zone, including (1) an upper shaft section defining an after-gasification zone, a lower shaft section below said after-gasification zone containing, a fluidized bed of granular fuel positioned and maintained in the lower portion of said fuel gasification zone and means for injecting a gasification agent into said fluidized bed;

(b) an upper enlarged cooling shaft section defining a gas cooling zone position above and in communication with said after-gasification zone, said gas cooling zone having a cross sectional area which is larger than that of said fuel gasification zone; and (c) a radiation tube boiler for containing a small water content compared with the heat content of the fuel bed and forming part of a steam generation plant with the radiation tube boiler surfaces being positioned completely within a recess formed by said enlargement of said gas cooling shaft section so that the boiler tube surfaces annularly surround effluent gases which pass through said upper shaft section, said boiler tube surfaces being positioned within said recess so that the reaction gas stream is not obstructed by said boiler tube surfaces as said gas stream moves through the cooling zone, said boiler tube surfaces further being dimensioned so that their cooling effect is only so great that gasification residues entrained with the effluent gas are not able to sinter to surfaces of the equipment in the subsequent path of the effluent gas.

2. A shaft furnace according to claim 1 wherein the cross-sectional area of the upper enlarged cooling shaft section defining said gas cooling zone is approximately twice as large as the cross-sectional area of the shaft section defining the underlying gasification zone.

3. A shaft furnace according to claim 1 or 2 wherein the shaft section defining the fuel gasification zone is in communication with the upper enlarged cooling shaft section defining the gas cooling zone in such a manner that an erosion effect accompanying the enlargement of the shaft and caused by eddying of the gas passing from one section to the other is avoided at the cooling tube surfaces.

4. A shaft furnace according to claim 3 wherein the enlarged cooling shaft section is connected to the upper shaft section by a conical wall section which is inclined at an angle of 45° to the furnace axis.

5. A shaft furnace for gasifying fine-grained fuels such as coal or coke at normal or elevated pressure in a gasification zone comprising a fluidized bed and a diluted after-gasification zone above said bed with means for indirect cooling of the effluent gas in order to prevent gasification residues entrained with the gas from sintering to surfaces of equipment in the subsequent path of the gas, said furnace comprising:

(a) a lower shaft section defining a fuel gasification zone containing a fluidized bed of granular fuel, said lower shaft section having means for delivering gasifying agents and granular fuel;

(b) an upper shaft section above said lower section defining an after-gasification zone above said fluidized bed, said upper shaft section including means for delivering oxidizing fluids to gases from said lower shaft section, said means for delivering gasifying agents being located below said means for delivering oxidizing fluids;

(c) a cooling section located above said upper shaft section and defining a gas cooling zone in communication with said gasification zone, said cooling section having a cross-sectional area about twice as large as that of said fuel gasification and after-gasification zones;

(d) said cooling zone including a radiator tube boiler forming part of a steam generation plant with the radiation tube boiler surfaces being positioned completely within a recess formed by said cooling section to annularly surround effluent gases which pass from said after-gasification zone through the cooling section, said boiler tube surfaces being positioned within said recess so that the reaction gas stream is not obstructed by said boiler tube surfaces as said gas stream moves through the cooling zone, said boiler tube surfaces further being dimensioned so that their cooling effect is only so great that gasification residues entrained within the effluent gas are not able to sinter to the surfaces of the equipment in the subsequent path of the effluent gas, the radiation of cold into the after-gasification zone is minimized; and (e) said cooling section being connected to said upper section by a conical wall section inclined at an angle of about 45° to the furnace axis.

* * * * *

UNITED STATES PATENT OFFICE

CERTIFICATE OF CORRECTION

Patent No. 4,349,354 Dated September 14, 1982

Inventor(s) Wilhelm Flesch

It is certified that error appears in the above-identified patent and that said Letters Patent are hereby corrected as shown below:

Column 1, line 8, "to" should be --or--.

Column 1, line 12, "finegrained" should read --fine-grained--.

Column 2, line 48, "therebetween" should be --therebeneath--.

Column 3, line 15, "is" should be --in--.

Column 4, line 6, after "zone," insert --and--.

Column 4, line 7, before "a" insert --(2)--.

Column 4, line 8, after "containing" delete the ",".

Column 4, line 13, "position" should be --positioned--.

Column 6, line 6, "within" should be --with--.

Column 6, line 10, "the" (1st. occurrence) should be--and--

Signed and Sealed this

Fourteenth Day of December 1982

[SEAL]

Attest:

GERALD J. MOSSINGHOFF

Attesting Officer

Commissioner of Patents and Trademarks